US008057031B2

(12) United States Patent
Willems et al.

(10) Patent No.: US 8,057,031 B2
(45) Date of Patent: Nov. 15, 2011

(54) METHOD OF FORMING A PHASE CHANGE INK IMAGE ON A SELF-LAMINATING RECORDING MEDIUM

(75) Inventors: Guido G. Willems, Venlo (NL); Johannes P. J. C. Rooijakkers, Velden (NL); Rudolf A. H. M. Sturme, Maasbree (NL)

(73) Assignee: OCE-Technologies B.V., Venlo (NL)

( * ) Notice: Subject to any disclaimer, the term of this patent is extended or adjusted under 35 U.S.C. 154(b) by 924 days.

(21) Appl. No.: 11/892,108

(22) Filed: Aug. 20, 2007

(65) Prior Publication Data

US 2008/0049090 A1 Feb. 28, 2008

(30) Foreign Application Priority Data

Aug. 22, 2006 (EP) ..... 06119292

(51) Int. Cl.
*B41J 2/01* (2006.01)

(52) U.S. Cl. ..... 347/100; 347/101; 347/103; 347/105; 428/32.25; 428/32.35; 428/32.37

(58) Field of Classification Search ..... 347/100–102, 347/104–105, 103; 428/32.25, 32.35, 32.37
See application file for complete search history.

(56) References Cited

U.S. PATENT DOCUMENTS

| | | | | |
|---|---|---|---|---|
| 4,724,025 | A | 2/1988 | Nishikawa et al. | |
| 4,832,984 | A * | 5/1989 | Hasegawa et al. | 427/161 |
| 5,006,387 | A * | 4/1991 | Takao et al. | 428/64.5 |
| 5,374,475 | A * | 12/1994 | Walchli | 428/304.4 |
| 6,140,390 | A * | 10/2000 | Bugner et al. | 523/160 |
| 6,471,758 | B1 * | 10/2002 | Kelderman et al. | 106/31.29 |
| 6,497,480 | B1 | 12/2002 | Wexler | |
| 6,497,940 | B1 | 12/2002 | Valentini et al. | |
| 6,550,909 | B2 * | 4/2003 | Ichinose et al. | 347/105 |
| 6,811,253 | B1 | 11/2004 | King et al. | |
| 6,905,203 | B2 | 6/2005 | Kremers et al. | |
| 2003/0234841 | A1 | 12/2003 | Pan et al. | |
| 2004/0109957 | A1 * | 6/2004 | Sen | 428/32.1 |
| 2006/0204684 | A1 * | 9/2006 | Missell et al. | 428/32.34 |

FOREIGN PATENT DOCUMENTS

| | | |
|---|---|---|
| EP | 0518621 A | 12/1992 |
| EP | 1067157 B1 | 1/2001 |

OTHER PUBLICATIONS

Publication No. 497067, Sep. 2005 Volume of Research Disclosure.

* cited by examiner

*Primary Examiner* — Matthew Luu
*Assistant Examiner* — Rut Patel
(74) *Attorney, Agent, or Firm* — Birch, Stewart, Kolasch & Birch, LLP

(57) ABSTRACT

A method of creating an image on a recording medium including a support having thereon a porous fusible layer, using an ink composition that is solid at room temperature and liquid at elevated temperature including the steps of generating droplets of the ink composition with an ink jet print head, transferring the droplets of the ink composition to the surface of the fusible layer, thermally treating the recording medium such that the ink transferred to fusible layer passes into the medium away from the surface of the fusible layer while the fusible layer remains substantially unfused, and when the ink has passed into the medium, treating the recording medium to fuse the fusible layer to become a protective overcoat. The present invention also pertains to a system for creating an image on a recording medium.

11 Claims, 3 Drawing Sheets

METHOD OF FORMING A PHASE CHANGE INK IMAGE ON A SELF-LAMINATING RECORDING MEDIUM

This application claims priority from European Patent Application No. 06119292.8 filed on Aug. 22, 2006, the entire contents of which is hereby incorporated by reference.

BACKGROUND OF THE INVENTION

The present invention pertains to a method of creating an image on a recording medium with an ink composition that is solid at room temperature and liquid at elevated temperature. The present invention also pertains to a system for creating an image on a recording medium with said ink composition.

A method of creating an image on a recording medium with an ink composition that is solid at room temperature and liquid at elevated temperature (also called "hot melt" or "phase change ink") is known from U.S. Pat. No. 6,497,940. This patent describes a recording medium for the ink composition which has improved clarity, improved resistance to surface scratching and improved ink adhesion. The recording medium comprises a polyethylene terephthalate support coated with a lower receptor layer comprising 82-97 wt. % of silica and 3-18 wt. % of PVA, polyvinylpyrrolidone, polyacrylamide, methylcellulose or gelatin. An optional upper layer comprises 32-70 wt. % of a matrix polymer, 15-52 wt. % of inorganic particulate material and 5-53 wt. % of soft polymer mixture. The term 'soft polymer mixture' describes a polymer or mixture of polymers that soften during the image transfer step of the printing. The softening allows the ink composition and the upper layer to become chemically or physically mated for mechanical durability reasons. The soft polymer matrix must be sufficiently soft to allow the ink composition and the coating to become intimately interrelated and yet rigid enough to avoid scratching and sticking with adjoining films.

Although suitable to obtain adequate mechanical durability, a disadvantage of this known method is that the print quality deteriorates when the printed medium is subjected to thermal load, for example by storing the printed medium at 35° C. for several weeks or months. It is, for example, noticed that the gloss level decreases substantially, and that local artefacts arise in the printed images.

SUMMARY OF THE INVENTION

The object of the present invention is to provide an improved method of obtaining images of a hot melt ink that overcomes or at least mitigates the disadvantages of the known method. To this end an ink jet printing method has been devised, using a recording medium comprising a support having thereon a porous fusible layer, comprising the steps of generating droplets of the ink composition with an ink jet print head, transferring the droplets of the ink composition to the surface of the fusible layer, thermally treating the recording medium such that the ink transferred to the fusible layer passes into the medium away from the surface of the fusible layer while the fusible layer remains substantially unfused, and when the ink has passed into the medium, treating the recording medium to fuse the fusible layer to become a protective overcoat.

With this method, in contrast with the prior art method, the ink, due to the thermal treatment, passes into the medium such that an upper layer arises that is substantially free of ink, i.e., substantially free of at least the meltable vehicle components of the ink (which typically constitute 90-99% of the hot melt ink). Then, this upper layer is fused (optionally together with other parts of the medium), which can be done by any known physical or chemical method that allows the porous layer to become a fused layer, to become a protective overcoat. In this way a continuous film (i.e., a film wherein the pores or interstices have disappeared for the major part) is created that substantially shuts off interaction between the environment and the ink trapped in the medium. It appears that, next to a very good mechanical durability, a very durable high gloss can be achieved with the method according to the present invention, even under circumstances of relatively high thermal load.

Inventors have found that a porous fusible layer, i.e., a layer having pores or interstices permitting the passage of fluid ink, in itself is not sufficient to arrive at the result that is obtainable with the present invention. It is essential that the recording medium is thermally treated such that the ink passes into the medium away from the surface of the fusible layer. Otherwise, ink can remain on the surface and thus an ink free upper layer cannot be readily provided. However, the thermal treatment should be such that the fusible layer remains substantially unfused while the ink passes into the medium. This is to prevent the premature amalgamation of the ink and the fusible layer as is known from the prior art. The thermal treatment in itself is not restricted to any type of treatment but can be for example radiation treatment, contact treatment, conductive treatment etc. This treatment can take place before the ink is transferred to the surface of the recording medium (pre-heating of the medium), at the same time, afterwards, or even a combination of these methods can be used, as long as it leads to a temperature rise of (parts of) the medium that allow passing of the hot melt ink into the medium while preventing substantial fusing of the fusible layer.

In the method according to the present invention, the treatment to fuse the porous layer should not be performed until the ink has passed into the medium to create an ink free upper layer. It is noted however that the treatment to fuse the porous layer and the thermal treatment to allow the ink to pass into the medium could for, example, be accomplished by a one-step thermal treatment, for example by passing the printed recording medium through one single pair of heated rollers. By applying such heated rollers, the viscosity of the ink droplets that reside on the surface of the porous layer can be forced to decrease to a value of typically about 10 mPa·s when heated above the melting point of the ink (for example, heating to 120° C. for an ink with a melting point of 90° C.). Although such a high temperature might also be sufficient to fuse a fusible layer consisting of a polyester polymer with a glass-transition temperature of for example 65° C., the time scale for the migration of the fluid ink into the medium is typically much (10 to 1000 times) shorter than the time scale for the fusing of the fusible (polymer) layer. Thus, what appears to be one single thermal treatment at first glance, can, under certain circumstances and with the right choice of materials, in effect be regarded as a first treatment enabling ink to pass into the medium to provide an ink free upper layer, followed by a treatment to fuse the fusible layer, i.e., at least the ink free upper part of that layer, to form a closed, protective overcoat.

Ink compositions that are solid at room temperature and liquid at an elevated temperature are commonly known. Examples of such an ink compositions are given in EP 1 067 157 and publication number 497067 in the September 2005 Volume of Research Disclosure (published by Emsworth Design Inc., Park Avenue South, N.Y., USA). The exemplified inks are composed of a mixture of a crystalline base material, an amorphous binder and a gelling agent.

In order to print the ink composition by way of an ink jet head, the ink composition needs to be in the fluid state. This requires the use of an ink jet head that can operate at temperatures above the melting temperature of the ink, typically at temperatures between 90 and 140° C. To this end, print heads can be used that comprise heated pressure chambers filled with the fluid ink and connected to nozzles, wherein the pressure required to fire a droplet is generated by firing a transducer, such as for example a piezo-electric transducer.

The recording medium as used in the method according to the present invention comprises a support for the porous fusible layer. This support can be opaque, translucent or transparent. There may be used, for example, plain papers, resin coated paper, various plastics including a polyester resin such as poly(ethylene-terephthalate), poly(ethylene-naphtalate), a polycarbonate resin, a fluorine resin such as poly(tetra-fluoro ethylene), metal foil, vinyl, fabric, and laminated or coextruded supports. Inkjet papers that can be used as a support in the meaning of the present invention are also described in the proceedings of the TAPPI Coating Conference of 2002, that is, in the paper by Hyun-Kook Lee, Margaret Joyce, Paul Flemming and John Cameron of the Western Michigan University (see for example Table 1 of this paper).

The fusible layer may comprise, e.g., fusible polymeric particles. The particles may have any size provided that when constituted as a layer, they provide for pores or interstices that allow the fluid ink to pass into the medium and create an ink free upper layer, and upon a fusing treatment will coalesce to form a continuous overcoat film. Typical particle sizes are in the range of 1-10 micrometers.

It is noted that U.S. Pat. No. 6,497,480 describes an ink jet recording element containing a support having, in sequence, a porous ink-retaining layer and a fusible porous ink-transporting layer comprising fusible polymeric particles and a film-forming hydrophobic binder. U.S. Pat. No. 6,811,253 describes an ink jet printing method, comprising printing onto a receiving medium having an ink receiving layer and an upper protective layer and heating the printed image to form a stable image-protecting coating. The upper protective layer comprises particulate polymeric beads having a film-forming temperature of 100-120° C. with a hydrophilic binder. This invention conveniently protects ink jet images.

The technical disclosure of these patents, however, is restricted to the use of water or solvent based inks. These inks are completely different from hot melt inks, not only in their intrinsic properties, but also in their behaviour when printed on media. In particular, these inks do not suffer from the problem of gloss deterioration when printed onto dedicated ink jet gloss media. In addition, these inks are fluid at room temperature and thus readily migrate through the fusible ink transporting layer into the ink receiving layer. Indeed, both references are silent with respect to a thermal treatment enabling the ink to pass into the recording medium. Thus, it is clear that the method according to the present invention cannot be found in the disclosure of these references.

According to the present invention, the recording medium that is used has a support comprising a base layer containing an ink receiving layer. The base layer may be any suitable layer for providing adequate mechanical strength or other property if needed (depending on the application). The ink receiving layer is designed to absorb the ink that passes into the medium. Such an absorptive layer can be constituted in many forms, as long as the interaction with the ink is such that the ink can be absorbed, either partly or completely, in this layer. In a further embodiment the ink receiving layer is a micro-porous layer. Such a layer comprises pores or interstices with a cross-section in the (sub-)micrometer range. Such a layer can contain organic or inorganic particles and typically has a thickness of about 1 μm to about 50 μm. Examples of organic particles that may be used include acrylic resins, styrene resins, cellulose derivatives, polyvinyl resins, ethylene-allyl copolymers and polycondensation polymers. Examples of inorganic particles that can be used in the ink receiving layer include silica, alumina, titanium dioxide, clay, calcium carbonate, barium sulfate or zinc oxide. The micro-porous ink receiving layer may comprise from about 20% to about 100% of particles and from about 0% to about 80% of polymeric binder, preferably from about 80% to about 95% of polymeric particles and from about 20% to 5% of polymeric binder. The polymeric binder may be a hydrophilic or hydrophobic polymer (depending i.a. on the type of ink for which the receiving medium is designed), such as poly(vinyl alcohol), poly(vinylpyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like.

In one embodiment, the porous fusible layer comprises a thermoplastic material. This has the advantage that a thermal treatment can be used to fuse the layer to form the continuous protective overcoat. The material constituting the fusible layer can, in principle, be any thermoplastic material composed of a thermoplastic compound only, or from a combination of a thermoplastic compound with, for example, a film forming polymer or other additives (in any ratio), depending on the specific application of the recorded medium. For example, if the recorded medium will be subjected to temperatures above 80° C., it is recommended that the thermoplastic material has a glass transition temperature above 80° C., in particular above 90° C. Examples of suitable thermoplastic compounds include polyesters, polyesteramides, polyethylenes and polyurethanes.

In another embodiment the fusible layer is provided on the support via a screen printing technique. Surprisingly it has been found that by using a screen printing technique, which in itself is commonly known, in a very simple and convenient way, a porosity can be provided that is adequate to allow fluid hot melt ink to pass into the recording medium, while still being "dense" enough to allow adequate fusing under moderate loads, such as for example, a moderate temperature and/or pressure rise. Other techniques, such as rod coating of resins, or resin dispersions in aqueous or non-aqueous solvents, optionally in addition with a mechanical method to force pores or interstices in the fusible layer, can provide for the same result but are less practical in use.

In another embodiment the ink composition comprises a meltable ink vehicle consisting at least of a material which is in a crystalline phase at 25° C. Preferably, the crystalline material of the ink vehicle and the material constituting the fusible layer are substantially incompatible at 25° C., i.e., both materials do not spontaneously mix at molecular levels at this temperature. In this way, the durability is further improved.

In another embodiment the fusible layer comprises a material having a glass transition temperature higher than 50° C. With such a glass transition temperature, the sticking together of the recording media can be prevented when a stack of media is exposed to a temperature of up to approximately 50° C. On the other hand, it is preferable that the glass transition temperature is lower than 70° C. to enable fusing of the layer by applying a moderate temperature rise.

The present invention also pertains to a system for creating an image on a recording medium comprising a support having disposed thereon a porous fusible layer, the system comprising an ink jet print head adjusted to jet droplets of an ink composition that is solid at room temperature and liquid at an elevated temperature, and the transfer these droplets to the surface of the fusible layer, the system optionally including an intermediate member for temporarily accepting the droplets of the ink composition before the said transfer to the fusible layer, and further comprising a thermal treating element for thermally treating the recording medium and a control arrangement for controlling the thermal treating element such that the ink transferred to the fusible layer passes into the medium away from the surface of the fusible layer while the fusible layer remains substantially unfused, and a transporting means for transporting the recording medium from the ink transfer position to a fuse position adjacent fusing means capable of treating the recording medium to fuse the fusible layer to become a protective overcoat. The control arrangement can be any piece of hardware that is designed to control the thermal treatment of the recording medium (for example in the form of an ASIC). However, the control arrangement does not essentially need to be one single piece of hardware, but rather may be distributed over the entire system. Moreover, this arrangement can in a smaller or larger part be provided in the form of software running on one or more processors (generic and/or programmable), which software is used to control the corresponding hardware. All kinds of control arrangements can be designed to be suitable, as long as they are capable of adequately controlling the thermal treatment of the recording medium in line with the present invention.

The optional intermediate member may be a belt or a drum, optionally having an elastomeric top layer such as for example an intermediate medium known from US 2003/0234841 A1 (see FIG. 1, element 14) or U.S. Pat. No. 6,905,203 (see FIG. 1, element 1). When using such an intermediate medium, the entire image can be printed on the intermediate member prior to being transferred to the recording medium. Using an intermediate member has the advantage that the process is more reliable, especially with respect to blocking of the nozzles by paper dust, and less dependent on variations in the type of recording medium.

BRIEF DESCRIPTION OF THE DRAWINGS

The present invention will be further explained by means of the following non-limitative illustrative figures and examples, wherein.

DETAILED DESCRIPTION OF THE INVENTION

Example 1 describes a process of making a recording medium for use in the method according to the present invention.

Example 2 describes a result that can be achieved with the method according to the present invention.

Figure 1:
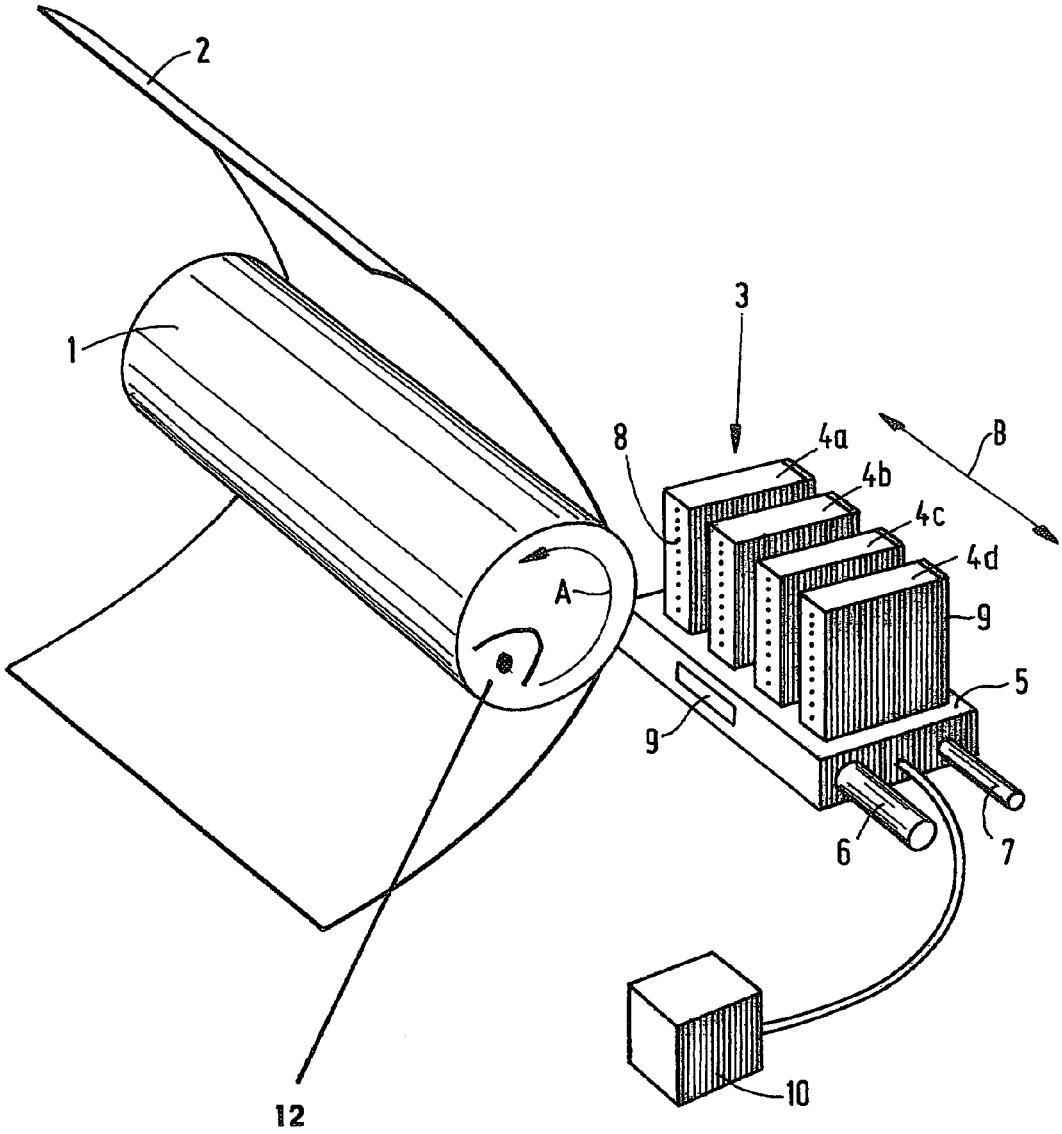
FIG. 1 is a schematic representation of an inkjet printer comprising multiple print heads.

FIG. 1 is a diagram showing an inkjet printer. According to this embodiment, the printer comprises a roller 1 used to support a recording medium 2, for transporting it along the carriage 3. This carriage 3 comprises a carrier 5 to which four print heads 4*a*, 4*b*, 4*c* and 4*d* have been fitted. Each print head 4*a*, 4*b*, 4*c*, 4*d* contains its own color, in this case cyan (C), magenta (M), yellow (Y) and black (K), respectively. The print heads 4*a*, 4*b*, 4*c*, 4*d* are heated using heating elements 9, which have been fitted to the rear of each print head 4*a*, 4*b*, 4*c*, 4*d* and to the carrier 5. The temperature of the print heads 4*a*, 4*b*, 4*c*, 4*d* is maintained at the correct level by application of a central control unit 10 (controller). The roller 1 may rotate around its own axis as indicated by arrow A. In this manner, the receiving medium may be moved in the sub-scanning direction (often referred to as the X direction) relative to the carrier 5, and therefore also relative to the print heads 4*a*, 4*b*, 4*c*, 4*d*. The carriage 3 may be moved in reciprocation using suitable drive mechanisms (not shown) in a direction indicated by double arrow B, parallel to roller 1. To this end, the carrier 5 is moved across the guide rods 6 and 7. This direction is generally referred to as the main scanning direction or Y direction. In this manner, the receiving medium 2 may be fully scanned by the print heads 4*a*, 4*b*, 4*c*, 4*d*. According to the embodiment as shown in this figure, each print head 4*a*, 4*b*, 4*c*, 4*d* comprises a number of internal ink chambers (not shown), each with its own exit opening (nozzle) 8. The nozzles 8 in this embodiment form one row per print head perpendicular to the axis of roller 1 (i.e., the row extends in the sub-scanning direction). In a practical embodiment of an inkjet printer, the number of ink chambers per print head will be many times greater and the nozzles 8 will be arranged over two or more rows. Each ink chamber comprises a piezoelectric converter (not shown) that may generate a pressure wave in the ink chamber so that an ink drop is ejected from the nozzle of the associated chamber in the direction of the receiving medium 2. The converters may be actuated image-wise via an associated electrical drive circuit (not shown) by application of the central control unit 10. In this manner, an image made up of ink drops may be formed on receiving medium 2. If a receiving medium 2 is printed using such a printer where ink drops are ejected from ink chambers, this receiving medium 2, or some of it, is (imaginarily) divided into fixed locations that form a regular field of pixel rows and pixel columns. According to one embodiment, the pixel rows are perpendicular to the pixel columns. The individual locations thus produced may each be provided with one or more ink drops. The number of locations per unit of length in the directions parallel to the pixel rows and pixel columns is referred to as the resolution of the printed image, for example indicated as 400×600 d.p.i. ("dots per inch"). By actuating a row of print head nozzles 8 of the inkjet printer image-wise when it is moved relative to the receiving medium 2 as the carrier 5 moves, an image, or some of it, made up of ink drops is formed on the receiving medium 2, or at least in a strip as wide as the length of the nozzle row.

Roller 1 is internally provided with a radiation heater 12, which heater is configured to heat the receiving medium 2 by heating the roller circumference which gives off its heat to the medium that contacts the roller 1. In this way, the recording medium can be treated to allow the hot melt ink to pass into the medium immediately after the corresponding ink droplets have hit the surface of the recording medium. The heater 12 is controlled by a piece of control software that is incorporated in controller 10. In this embodiment, the software makes use of a memory which comprises numerous combinations of inks that can be used in the printer and recording media that can be used according to the present invention. Each combination is linked to a dedicated setting of the temperature of the roller, which setting is the parameter to be directly controlled in the embodied system. That is, the temperature of the roller surface is measured using a contact sensor (not shown) and compared to the pre-programmed temperature setting.

Depending on the difference between the pre-programmed temperature and the measured temperature, the heater is controlled to make this difference as small as necessary.

Figure 2:
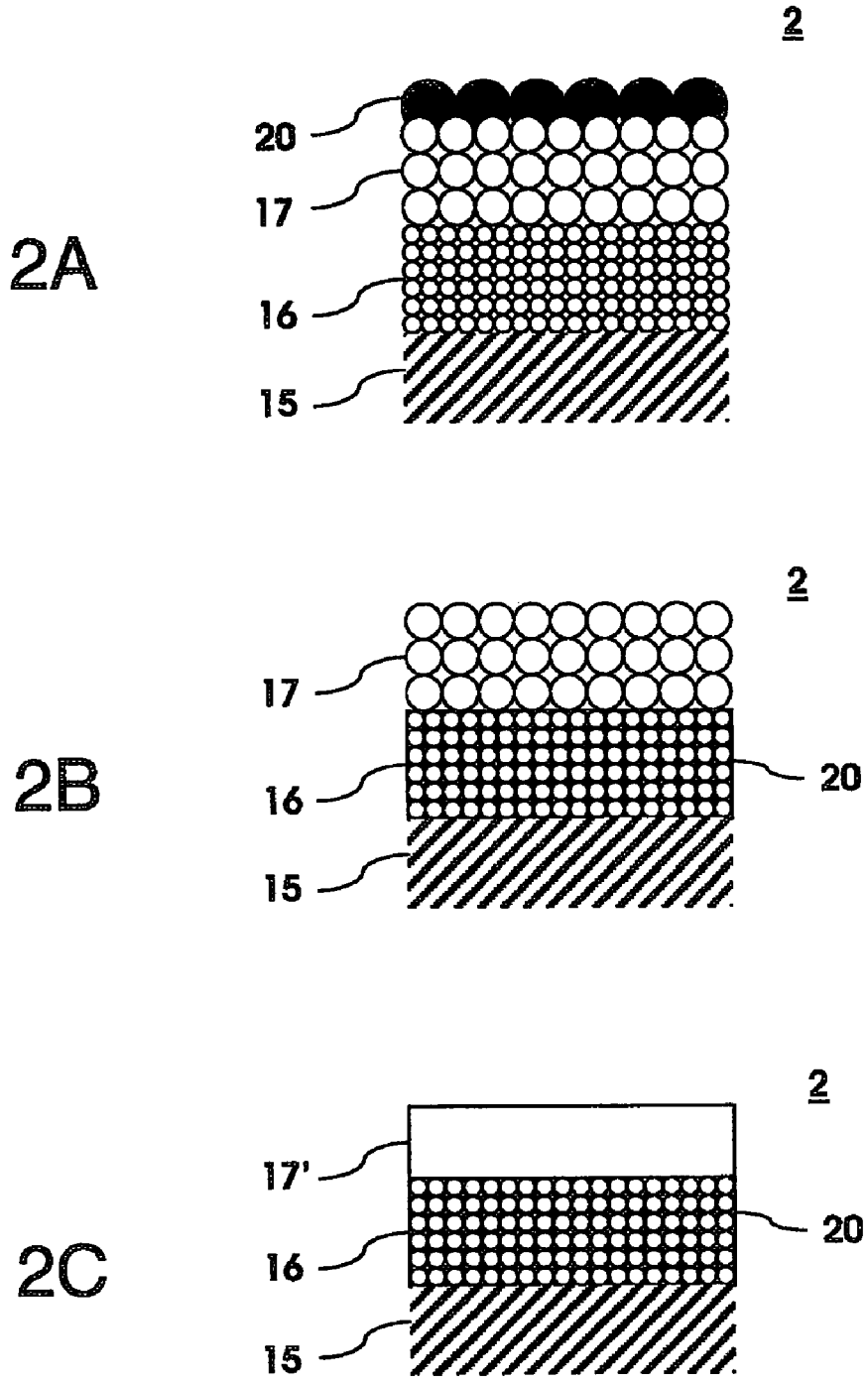
FIG. 2A is a schematic representation of the recording medium prior to thermal treatment of the recording medium.
FIG. 2B is a schematic representation of the recording medium after the thermal treatment.
FIG. 2C is a schematic representation of recording medium after the fusing treatment.

FIG. 2 is a schematical representation of the interaction of phase change ink with a recording medium according to an embodiment of the present invention. FIG. 2A shows the recording medium comprising a base layer 15 and an ink receiving layer 16 (which together form a support in the sense of the present invention) and a fusible layer 17. The base layer in this case is a plain paper substrate. The ink receiving layer is a commonly used formulation of 90% by weight of silica nano particles in the range of 300 to 30 nanometers in 10% by weight of polyvinyl alcohol. The high weight fraction of particulate material with respect to the binder fraction results in a highly porous layer that has good ink retaining properties.

The fusible layer is a film of thermoplastic polymer particles (polyester resin; Mn=900, Tg=55° C.). These particles have an average size between 2 to 5 μm and are rod-coated on the support starting with an aqueous dispersion of the particles (10 weight % of resin in water) to provide a film of about 20 μm in thickness. On top of the fusible layer 17 lies a layer of solid phase change ink droplets 20 that has been jetted onto the surface of the recording medium.

FIG. 2B represents the situation after the thermal treatment of the recording medium. The ink droplets that resided on top of the fusible layer have passed into the recording medium, in this case into the ink receiving layer 16, away from the surface of the fusible layer which remained substantially unfused. In this particular case, after the ink has passed into the medium, the complete fusible layer is substantially free of ink. It is noted however that the present invention also encompasses that only an upper layer of the fusible layer has become substantially free of ink.

FIG. 2C depicts the situation after a fusing treatment of the recording medium. The fusible layer has been fused to form a closed, protective overcoat 17'. In this case the complete layer 17 has been fused to become layer 17'. It should be understood however that the present invention as claimed in the appended claims also compasses that only the upper ink free layer of the fusible layer is fused to become a protective overcoat.

Figure 3:
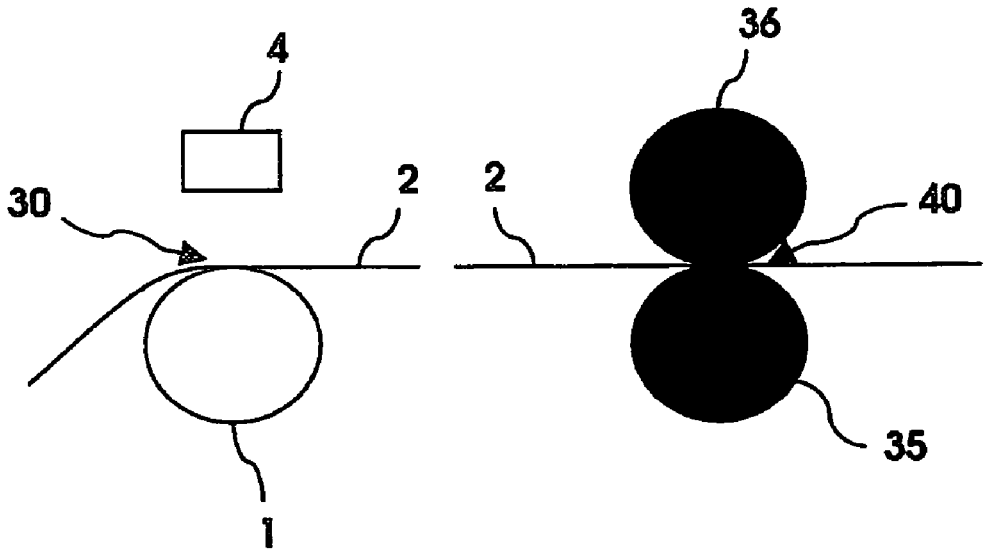
FIG. 3 is a schematic representation of an ink jet printer and fusing station.

FIG. 3 is a schematic representation of a system for creating an image according to the present invention. On the left, the inkjet printer as elaborately described with reference to FIG. 1 is depicted, by showing its most important components, i.e., the internally heated roller 1 for transporting the recording medium 2, and one of the printing heads 4. This system further comprises a fuse roller arrangement that consists of heated roller 36 and back roller 35 which are slightly pressed together (typical line pressure 250 Newton per meter) by adequate pressure providing means (not shown). Both rollers are provided with compliant surface layers, in this example soft silicone elastomer layers (20 ShA hardness). The transport roller 1 is capable of transporting the printed recording medium 2 from the ink transfer position 30 to fuse position 40. The rollers are heated to a temperature of about 140° C. which in this case (chosen resin for the fusible layer is a polyester resin with a Tg of 55° C.) is adequate to heat at least an upper layer of the fusible layer such that it fuses into a continuous protective overcoat.

Example 1

Example 1 describes a process of making a recording medium for use in the method according to the present invention. A resin is chosen, typically having a Tg (glass transition temperature) between 50 and 70° C. As an example, the polyester resin exemplified as resin number 3 in table 2 of international patent application PCT/EP2006/062614 is chosen. A 10% resin dispersion (10 weight percent of resin) in water is created such that the resin particles have an average size below 1 micron (which can be easily verified with a light scattering particle size measurement apparatus). The viscosity of this dispersion is in almost the same as that of the water itself and the dispersion has a milk-like appearance.

A clean screen that is commonly used in a screen printer is placed on top of a suitable substrate, in this case Kodak Instant Dry Glossy photo paper, 190 g. It is ensured that there is good contact between the screen and the substrate by supporting the substrate and putting adequate pressure on the framework of the screen. The screen in this case is made out of mono-filaments of an inert fabric, which filaments are 40 micron wide leaving openings of 20×20 micrometers.

The resin dispersion is applied on the side of the screen facing away from the substrate, making sure that it is not able to wet the substrate yet. With a rubber squegee the dispersion is applied over the whole screen in one movement. It is important that the squegee does not run dry because this will cause imperfections in the coated layer. Any surplus dispersion is removed from the screen because this can interact with the substrate causing cockling or too thick layers of coating. After the coating step, the screen and substrate are left in place to allow drying. This can be done under ambient conditions. After drying the screen is removed. This method results in a recording medium having on the substrate as a support, a fusible layer consisting of dots of the polyester resin of about 40×40 micrometers wide and a height of about 15 to 20 micrometers in a regular pattern and a open space of a few micron in between the dots. The thickness of the dots can be varied, for example by changing the amount of resin in the dispersion.

Other coating techniques for obtaining a fusible layer can also be successfully applied. For example, it is recognised that rod-coating techniques or cast coating techniques, both when starting from aqueous or non-aqueous media as a carrier for the fusible material, can be applied to obtain a recording media for use in the present invention. The present invention can also be applied to parts of recording media. For example, if an overcoat is only desired for a certain smaller image of a complete image (for example, a company name above a letter, which name should appear in high gloss), a medium could be made having the fusible layer only at the location corresponding to the company name.

Example 2

In this example a result is described that can be achieved with the method according to the present invention. With the screen print method described here-above ("example 1") four recording media are produced. For the fusible layer, four different kinds of resin are chosen, namely resin number 3 in table 2 of international patent application PCT/EP2006/062614, resin number 1 in the same table of that patent application, a polyester-amide resin having a $M_n$ (number averaged molecular weight) of 900 and a $T_g$ of 65° C., and a semi-crystalline polyolefin resin (available from Dow Chemical Corporation under the trade name "Engage").

These four materials are each printed with three different hot melt inks of a constitution as given in Table 1. Each of these ink compositions contains a crystalline material (K), an amorphous material (A) and a gelling agent (G). The ink compositions are provided with a dye (KI), Macrolex Rot (Bayer) in the case of the ink compositions I and III, Orasol Blau (Ciba-Geigy) in the case of composition II. In addition, the three ink compositions are provided with wetting agent (V) BYK 307 (Byk Chemie). The chemical formulae of the crystalline base material (K), the amorphous binder (A) and the gelling agent (G) are given in tables 2, 3a and 1 respectively of EP 1 067 157.

TABLE 1

| Hot Melt Ink Formulations | | | | | | | |
|---|---|---|---|---|---|---|---|
| | Ink I | | Ink II | | ink III | | |
| K | 58.3 | HMDI-MEG | 67.6 | CYCLO-2T | 66.8 | HMDI-MEG | Crystalline Material |
| A | 38.1 | DITRIM-50CHI | 28.8 | GLYPOCHI | 28.6 | PBPA-BuP | Amorphous Material |
| G | 3 | Gel-23 | 2 | Gel-1 | 4 | Gel-23 | Gelling Agent |
| KI | 0.5 | Macrolex Rot | 1.5 | Orasol Blau | 0.5 | Macrolex Rot | Dye |
| V | 0.1 | BYK 307 | 0.1 | BYK 307 | 0.1 | BYK 307 | Wetting Agent |

The inks are jetted at a temperature of 130° C. to the recording media which is maintained at a temperature of 35° C. Here-after, the recording media are transferred to an oven which is maintained at 90° C. After 30 seconds the inks have passed into the media, and they are transferred to an oven kept at 110° C. Here they stay for 90 seconds which is sufficient to fuse an ink free upper layer of the recording media. Then they are brought to ambient conditions.

To test the durability under thermal load, the printed and now "sealed" recording media are brought over to an oven at a temperature of 45° C. The image quality is inspected every 24 hours. A first relevant feature of the image quality is the gloss level (which can be measured for example using a Hunter 75° glossmeter according to TAPPI procedure T 480 OM-92). Another feature is the appearance of white spots, possibly a crystallisation effect of the crystalline material in the ink vehicle. It appears that during the first few days a slight deterioration of the gloss level occurs (typically from 70 to 60%). However, this decrease in gloss can hardly be noticed with the naked human eye. After that, the gloss level remains substantially constant, up to even 800 hours of thermal load. No white spots can be noticed with the naked human eye.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of creating an image on a recording medium including a support having disposed thereon a porous fusible layer, provided with an ink composition that is solid at room temperature and liquid at elevated temperature, said porous fusible layer being a film of thermoplastic polymer particles, the thermoplastic polymer particles having an average size of between 2 to 5 μm, which method comprises:

generating droplets of the ink composition with an ink jet print head, transferring the droplets of the ink composition to the surface of the fusible layer, thermally treating the recording medium such that the ink transferred to the fusible layer passes into the medium away from the surface of the fusible layer while the fusible layer remains substantially unfused, and when the ink has passed into the recording medium, treating the recording medium to fuse the fusible layer to become a protective overcoat.

2. The method according to claim 1, wherein the recording medium that is used has a support comprising a base layer with an ink receiving layer disposed thereon.

3. The method according to claim 2, wherein the ink receiving layer is a micro-porous layer.

4. The method according to claim 1, wherein the fusible layer is provided on the support via a screen printing technique.

5. The method according to claim 1, wherein the ink composition that is used comprises a meltable ink vehicle at least containing a material which is in a crystalline phase at 25° C.

6. The method according to claim 5, wherein the crystalline material of the ink vehicle and the material constituting the fusible layer are substantially incompatible at 25° C.

7. The method according to claim 1, wherein the fusible layer comprises a material having a glass transition temperature higher than 50° C.

8. A system for creating an image on a recording medium which comprises:

a support, a porous fusible layer disposed on the support, said porous fusible layer being a film of thermoplastic polymer particles, the thermoplastic polymer particles having an average size between 2 to 5 μm, an ink jet print head adapted to jet droplets of an ink composition that is solid at room temperature and liquid at an elevated temperature to the surface of the fusible layer, a thermal treating element operatively associated with the recording medium for thermally treating the recording medium, and a control means for controlling the thermal treating element such that the ink transferred to the fusible layer passes into the recording medium, away from the surface of the fusible layer, and means for fusing the fusible layer into a protective overcoat.

9. The system according to claim 8, wherein the fusible layer remains substantially unfused, while the ink transferred to the fusible layer passes into the recording medium, away from the surface of the fusible layer, and wherein the system further comprises transporting means for transporting the recording medium from an ink transfer position to a fuse position.

10. A system for creating an image on a recording medium which comprises:

an intermediate member for temporarily accepting the droplets of an ink composition that is solid at room temperature and liquid at an elevated temperature, a support, a porous fusible layer disposed on the support, said porous fusible layer being a film of thermoplastic polymer particles, the thermoplastic polymer particles having an average size between 2 and 5 μm, an ink jet print head adapted to jet droplets of the ink composition to the surface of the intermediate member, transfer means to transfer the ink from the surface of the intermediate member to the fusible layer, and a thermal treating element operatively associated with the recording medium for thermally treating the recording medium, a control means for controlling the thermal treating element such that the ink transferred to the fusible layer passes into the recording medium, away from the surface of the fusible layer, and means for fusing the fusible layer into a protective overcoat.

11. The system according to claim 10, wherein the fusible layer remains substantially unfused, while the ink transferred to the fusible layer passes into the recording medium, away from the surface of the fusible layer, and wherein the system further comprises transporting means for transporting the recording medium from an ink transfer position to a fuse position.

* * * * *